US007065929B2

(12) United States Patent
Manzella et al.

(10) Patent No.: US 7,065,929 B2
(45) Date of Patent: Jun. 27, 2006

(54) TWO PART WINDOW AND DOOR ASSEMBLY AND COUPLING FOR INTERCONNECTING COMPONENTS THEREOF

(75) Inventors: Francis Manzella, 412 Woodbridge Rd., Rockville Centre, NY (US) 11570; Harry M. Riegelman, Arlington, TX (US)

(73) Assignee: Francis Manzella, Rockville Centre, NY (US)

( * ) Notice: Subject to any disclaimer, the term of this patent is extended or adjusted under 35 U.S.C. 154(b) by 288 days.

(21) Appl. No.: 10/639,600

(22) Filed: Aug. 12, 2003

(65) Prior Publication Data

US 2005/0055908 A1 Mar. 17, 2005

(51) Int. Cl.
*E06B 1/04* (2006.01)

(52) U.S. Cl. ..... 52/204.1; 52/204.5

(58) Field of Classification Search ..... 49/504, 49/DIG. 1, 161, 181, 400, 404, 406, 414, 49/501, 408; 52/204.1, 213, 204.5, 204.6, 52/204.62, 211, 731.9, 309.13, 217; 29/418, 29/897.312; 206/517, 577; 403/402
See application file for complete search history.

(56) References Cited

U.S. PATENT DOCUMENTS

| | | | | | |
|---|---|---|---|---|---|
| 3,336,719 | A | * | 8/1967 | Hans | 52/731.9 |
| 3,420,026 | A | | 1/1969 | Nolan | |
| 3,455,080 | A | | 7/1969 | Meadrows | |
| 3,462,884 | A | * | 8/1969 | Bissoniere | 49/404 |
| 3,473,263 | A | * | 10/1969 | Osten, Sr. | 49/161 |
| 3,526,996 | A | * | 9/1970 | Arthur et al. | 49/504 |
| 3,694,961 | A | * | 10/1972 | Johnson | 49/414 |
| 3,711,995 | A | * | 1/1973 | Anderson | 49/504 |
| 3,774,345 | A | * | 11/1973 | Cole et al. | 49/504 |
| 3,783,559 | A | * | 1/1974 | Yocum et al. | 49/504 |
| 3,798,869 | A | | 3/1974 | Nipp | |
| 3,878,648 | A | * | 4/1975 | Maune | 49/400 |
| 3,903,669 | A | | 9/1975 | Pease, Jr. et al. | |
| 3,959,926 | A | * | 6/1976 | Noecker et al. | 49/181 |
| 4,044,503 | A | * | 8/1977 | Maune | 49/400 |
| 4,126,975 | A | | 11/1978 | Williams | |
| 4,151,682 | A | * | 5/1979 | Schmidt | 49/404 |

(Continued)

FOREIGN PATENT DOCUMENTS

DE 3841680 C1 11/1989

(Continued)

*Primary Examiner*—Naoko Slack
*Assistant Examiner*—Jessica Laux
(74) *Attorney, Agent, or Firm*—Gerald T. Bodner

(57) ABSTRACT

A two part window and door assembly includes a sill, head and jambs for the window or door frame and stiles and rails for a window sash. Each of the sill, head, jambs, stiles and rails is formed in two parts, that is, an interior part and an exterior part. A coupling is used to join together the interior part and the exterior part of each of the sill, head, jambs, stiles and rails. The coupling includes an outrigger formed as an elongated member on one of the interior part and the exterior part. The other of the interior part and the exterior part defines an outrigger receiving slot. The coupling includes a first hook and a second hook. The first and second hooks are disposed on one and the other of the interior part and the exterior part. The outrigger is received by the outrigger receiving slot, and the first and second hooks engage each other to join the interior part and the exterior part together. A locking spline is used to selectively maintain the engagement of the first and second hooks so that the interior part and the exterior part remain joined together.

16 Claims, 9 Drawing Sheets

U.S. PATENT DOCUMENTS 4,231,207 A 11/1980 Kern et al.
4,275,526 A * 6/1981 Abramson ..... 49/501
4,286,716 A * 9/1981 Budich et al. ..... 206/577
4,304,081 A * 12/1981 Dawson ..... 52/309.13
4,344,257 A * 8/1982 Anderson ..... 49/504
4,407,100 A 10/1983 Huelsekopf
4,555,868 A * 12/1985 Mancuso ..... 49/181
4,558,536 A * 12/1985 Dunsmoor ..... 49/404
4,569,154 A * 2/1986 Bayer ..... 49/504
4,594,812 A * 6/1986 Clancy et al. ..... 49/404
4,694,552 A * 9/1987 Ecker et al. ..... 29/418
4,725,324 A 2/1988 Schmidt
4,787,184 A 11/1988 Boidron
4,930,257 A * 6/1990 Windgassen ..... 49/504
4,944,118 A * 7/1990 Biro ..... 49/504
4,947,597 A 8/1990 Simpson
4,974,366 A * 12/1990 Tizzoni ..... 49/504
4,982,530 A * 1/1991 Palmer ..... 49/504
5,014,466 A * 5/1991 Winner ..... 49/504
5,072,547 A * 12/1991 DiFazio ..... 49/504
5,117,601 A 6/1992 Habicht
5,187,867 A * 2/1993 Rawlings ..... 29/897.312
5,274,955 A * 1/1994 Dallaire et al. ..... 49/406
5,289,659 A * 3/1994 Harrison ..... 49/501
5,297,891 A * 3/1994 Rosa ..... 403/402
5,325,648 A 7/1994 Ménard
5,379,518 A 1/1995 Hopper
5,388,372 A * 2/1995 Zanoni ..... 49/408
5,414,962 A 5/1995 Forbis et al.
5,469,683 A 11/1995 McKenna et al.
5,498,099 A 3/1996 Scheuer
5,515,652 A 5/1996 Klimek
5,553,420 A 9/1996 Klimek
5,557,899 A 9/1996 Dubé et al.
5,568,714 A 10/1996 Peterson
5,577,355 A 11/1996 Leonelli
5,647,172 A * 7/1997 Rokicki ..... 49/504
5,727,356 A 3/1998 Ensinger et al.
5,791,104 A * 8/1998 Baier et al. ..... 52/217
6,003,277 A 12/1999 Graham et al.
6,041,552 A 3/2000 Lindahl
6,094,874 A * 8/2000 Manzella ..... 52/204.62
6,202,353 B1 * 3/2001 Giacomelli ..... 49/504
6,253,507 B1 * 7/2001 Martino ..... 52/211
6,318,037 B1 11/2001 Hansen
6,330,769 B1 12/2001 Manzella et al.
6,412,227 B1 * 7/2002 De Zen ..... 49/504
6,675,537 B1 * 1/2004 Morton et al. ..... 49/504

FOREIGN PATENT DOCUMENTS

EP 0 556 916 A1 8/1993

* cited by examiner

TWO PART WINDOW AND DOOR ASSEMBLY AND COUPLING FOR INTERCONNECTING COMPONENTS THEREOF

BACKGROUND OF THE INVENTION

1. Field of the Invention

This invention generally relates to the construction of windows, doors and the like and to the joining of two pieces of extruded or non-extruded material for such constructions. More specifically, the invention relates to window and door assemblies, including the construction of fixed, double hung, sliding, tilt and turn and casement windows, and sliding and French doors, for example.

2. Description of the Prior Art

Most conventional windows and doors are typically constructed from one-piece extruded components. The jambs, head and sill of the window or door frame, and the stiles and rails forming the window sash, whether fixed or moveable, are each conventionally formed as a single extruded part which is then assembled with the other parts to form the frame or sash.

An example of such conventional construction for a double hung window is shown in FIGS. 1–5 of the drawings. The sill 2 (FIG. 1) includes a one-piece extruded outer shell 4, with holes which receive screws or bolts 6 (with the bolt heads visible in FIG. 1) for mounting to the jambs 8, 10. The outer shell 4 includes a thermal break 12, i.e., an insulating material that is poured and hardened in a longitudinally extending cavity 14 of the sill 2 between an interior side 16 and an exterior side 18 of the extruded outer shell 4 (the interior side 16 faces the interior of the building in which the window is mounted, and the exterior side 18 faces the exterior of the building). Longitudinal slots are cut through the extruded outer shell 4 defining the thermal break cavity 14 to define a gap 20 in the extrusion (especially if the extrusion is metal) to reduce the rate of heat transferred by conduction through the outer shell 4 of the sill 2 between the interior side 16 and the exterior side 18.

The head 22 (FIG. 2) has a similar structure to that described for the sill 2. It, too, has a one-piece extruded outer shell 24, with a thermal break 12, and mounting bolts or screws 6 received in corresponding holes for attaching the head 22 to the jambs 8, 10.

The jambs 8, 10, left and right, when viewing the window from the interior (FIGS. 3 and 4, respectively), also include a one-piece extruded outer shell 26 with a thermal break 12, and sidecut bores 28 for receiving the bolts or screws 6 of the sill 2 and head 22 for attaching the jambs to such.

Each sash of the conventional double hung window has a similar construction to that of the sill 2, head 22 and jambs 8, 10 of the frame. The opposite end rails 30, 32 are shown in FIGS. 1 and 2, and the stiles 34, 36 are shown in FIGS. 3 and 4. The meeting rails 38 are shown in FIG. 5. The stiles 34, 36 and rails 30, 32, 38 are formed from a one-piece extruded outer shell 40–48, each of which includes an insulating thermal break 12 formed in a longitudinal cavity 14, with gaps 20 to prevent thermal conduction between the exterior side 18 and the interior side 16 of the window. Bolts or screws 6 in either the stiles 34, 36 or rails 30, 32, 38 are received by sidecut bores 28 formed in the mating rails or stiles to assemble the sashes. The glazing 50 is securely held in place between the stiles 34, 36 and rails 30, 32, 38 by an arrangement of brackets 52 and beads 54 that may be formed as integrally extruded portions of the stiles and rails or may be made as separate components that resiliently latch into place when the window is assembled. Felt weatherstripping 56 held in place by T-slots formed in the sill 2, head 22 and jambs 8, 10 engage the stiles 34, 36 and rails 30, 32, 38 to minimize air leakage through the movable sash.

To simplify the explanation of the invention, only certain components of a conventional window have been described. The remaining components of the typical window shown in FIGS. 1–5 will be readily apparent to one skilled in this art and no need for further explanation is required. Also, although only a conventional double hung window has been described and shown in FIGS. 1–5, other windows, including fixed, tilt and turn, tilt before turn, sliding and casement, and doors, including French and sliding, will have a similar structure, in that the components thereof are each typically formed as a one-piece extruded structure, with thermal breaks 12, assembly hardware 6 and hardware receiving holes 28.

The transverse width of the stiles 34, 36 and rails 30, 32, 38 of the sash in combination with the transverse width of the jambs 8, 10, sill 2 and head 22 of the frame determine the overall depth or thickness of the window assembly. Furthermore, since the components of the sash and frame are all one-piece extrusions, the interior side 16 of the window assembly is the same material and color as the exterior side 18. Thus, the window assembly of the prior art is limited in its choice of thicknesses, materials and colors.

For example, the window assembly of the prior art does not afford the option of having different materials or colors between the interior and the exterior of the window. With conventional windows and doors that require a different finish on the exterior and interior sides, the customary practice is to apply the different finishes in separate and secondary masking operations on each member. This method requires extra handling and associated additional cost.

OBJECTS AND SUMMARY OF THE INVENTION

It is an object of the present invention to provide a coupling for joining two parts of a window or door together.

It is another object of the present invention to provide a two part window or door assembly.

It is a further object of the present invention to provide a window or door assembly which can be custom assembled to provide a variety of depths, materials and color choices.

It is yet another object of the present invention to overcome the inherent disadvantages of conventional windows and doors.

In accordance with one form of the present invention, a coupling for joining first and second components of a window or door assembly together includes an outrigger formed as an elongated member on the first component to be joined, an outrigger receiving slot defined by the second component to be joined, a first hook spaced a predetermined distance from the outrigger on the first component, and a second hook formed on the second component and spaced a predetermined distance from the outrigger receiving slot. The outrigger is received by the outrigger receiving slot, and the first and second hooks engage one another to secure the first and second components together in a fixed relationship. When the first and second components are assembled, the first hook of the first component and a wall of the second component define a space therebetween. A locking spline, which is preferably resilient, or another member, such as a wedge or the like, is press-fitted into the space between the first hook and the wall to exert pressure on each and to selectively prevent the disengagement of the first and second hooks and to maintain the components as an assembled, unitized structure, i.e., effectively as a one-piece unit. Preferably, the locking spline or similar component may be removed to allow the two components to be disassembled.

A two part window or door assembly, constructed in accordance with the present invention, includes such a coupling. Each, but not necessarily all, of the components of the window or door, including the sill, head and jambs of the frame, and the stiles and rails of the sash, comprises at least first and second parts. The first part would include the outrigger and first hook, as described previously, and the other part would include structure defining the outrigger receiving slot and the second hook, as also described previously.

The first and second parts are preferably extruded, although this need not be the case. Assuming they are extruded, their lengths could typically be twenty feet or more. The are then joined together using the coupling described previously, and held together by inserting the locking spline between the first hook of one part and a wall of the other part. The parts are then transversely cut to selected lengths to form the joined jamb, sill, head, stile or rail. These components are subsequently assembled to form the frame of the window or door, or the window sash.

The coupling joining the two parts together is preferably situated on the cooperating parts such that the outrigger faces the outer periphery of the window or door, with the hooks and locking spline being situated inwardly of the outrigger in relation to the outer periphery of the window or door. Orienting the coupling with the outrigger facing the outer periphery of the window or door helps conceal from view the locking spline when the window or door is installed and in the closed position.

With the coupling of the present invention, a two part window or door may be constructed, where the exterior side may be a different color from that of the interior side, or may be of a different material, such as aluminum or vinyl, while the interior is wood, for example. Also, the interior and exterior depths of the windows or doors may be selected as required. Additionally, the locking spline may be removed so that the window or door, and more particularly, the joined components of the frame or sash, may be disassembled and reassembled with mating components of different depths, finishes or materials, as desired.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 2:
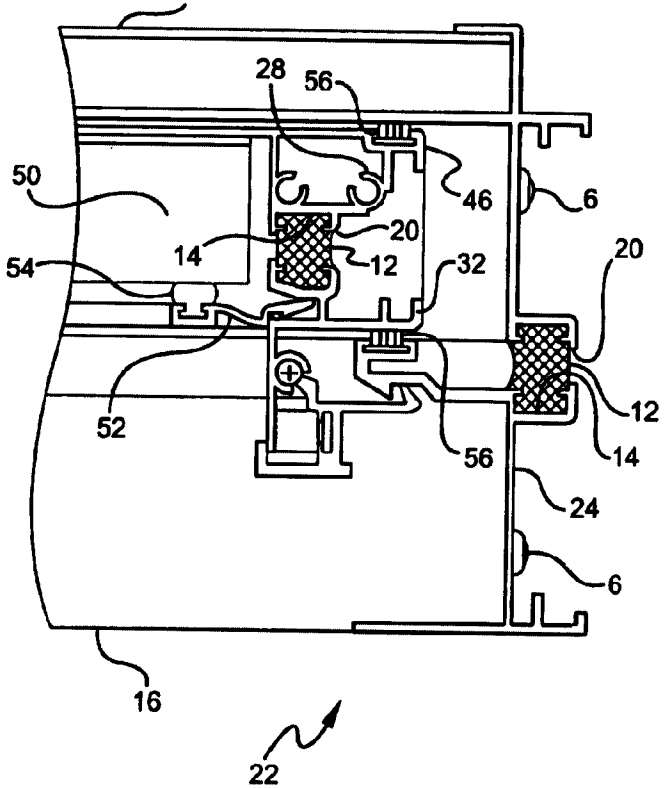
FIG. 2 (Prior Art)
FIG. 2 is a partial cross-sectional view of a head of a conventional double hung window.
Figure 1:
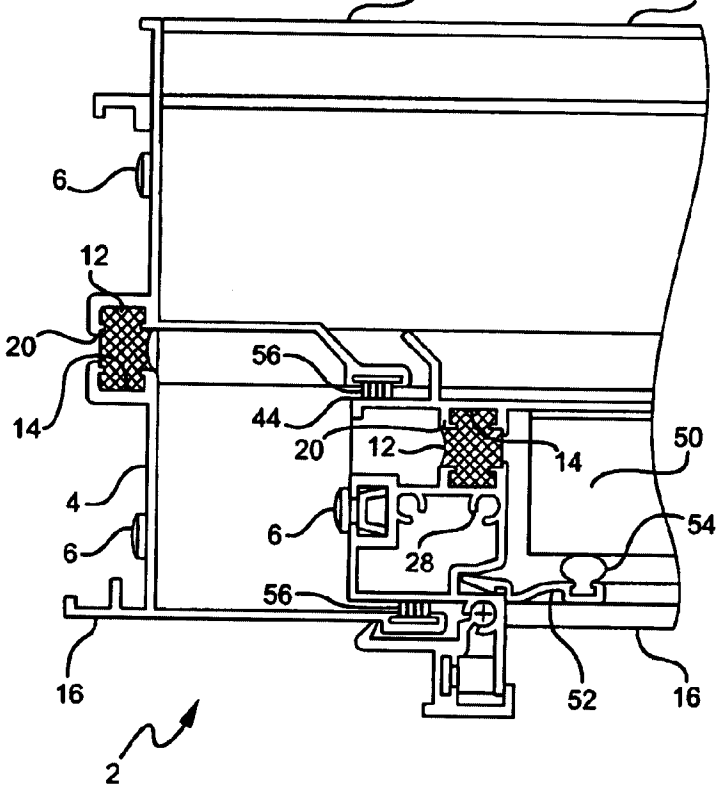
FIG. 1 (Prior Art)
FIG. 1 is a partial cross-sectional view of a sill for a conventional double hung window.
Figure 3:
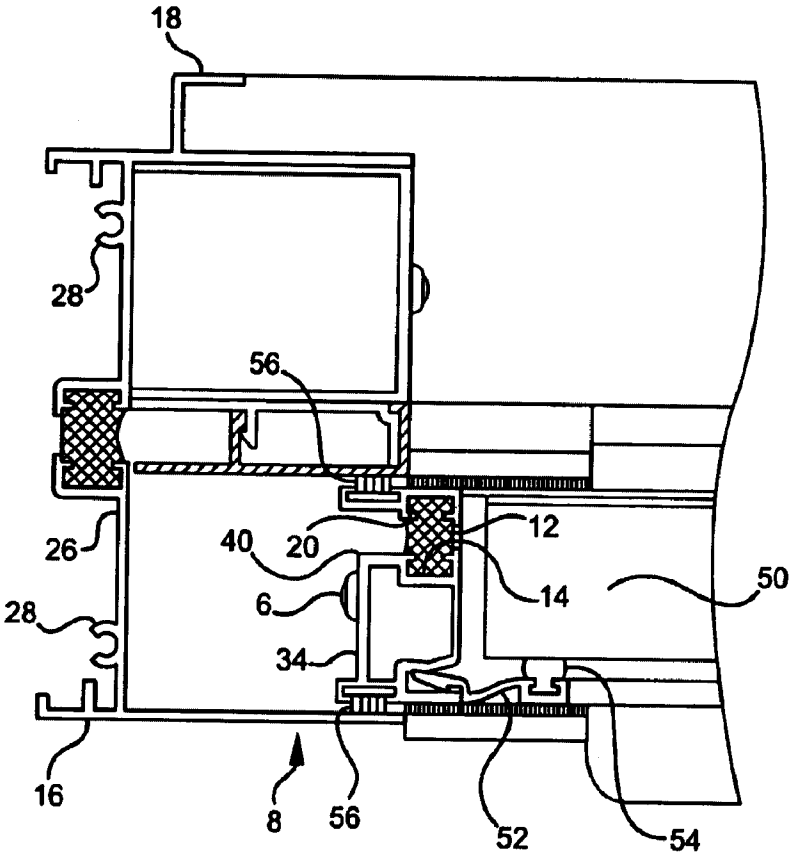
FIG. 3 (Prior Art)
FIG. 3 is a partial cross-sectional view of one jamb of a conventional double hung window.
Figure 5:
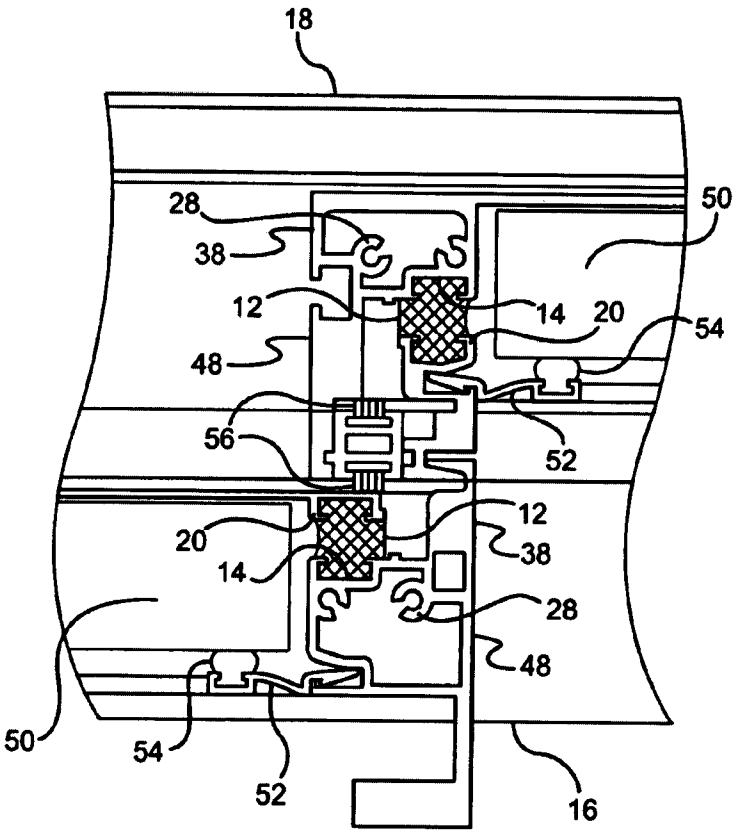
FIG. 5 (Prior Art)
FIG. 5 is a partial cross-sectional view of the meeting rails of the sashes for a conventional double hung window.
Figure 4:
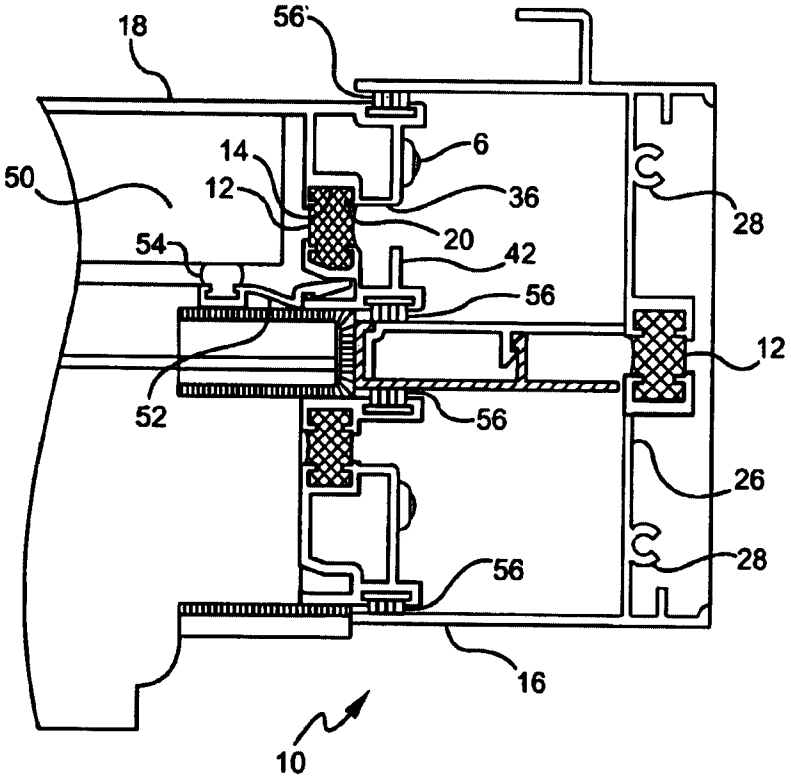
FIG. 4 (Prior Art)
FIG. 4 is a partial cross-sectional view of the opposite jamb of a conventional double hung window.
Figure 6:
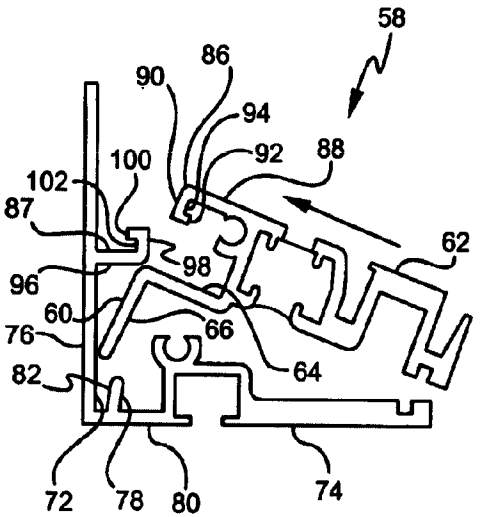
FIG. 6 is a partial cross-sectional view of a coupling formed in accordance with the present invention for joining two components together, and further illustrating the sequence of steps in joining the two components together using the coupling of the present invention.
Figure 7:
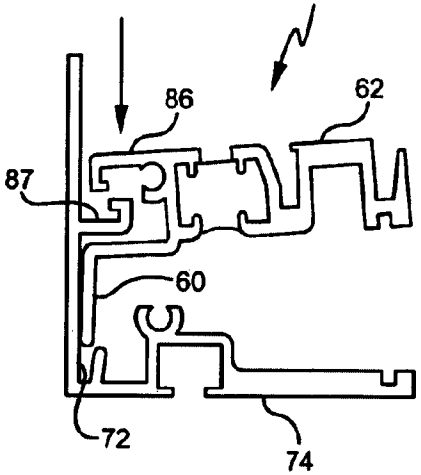
FIG. 7 is a partial cross-sectional view of the coupling formed in accordance with the present invention and shown in FIG. 6, and further illustrating the sequence of steps in joining two components together using the coupling of the present invention.
Figure 8:
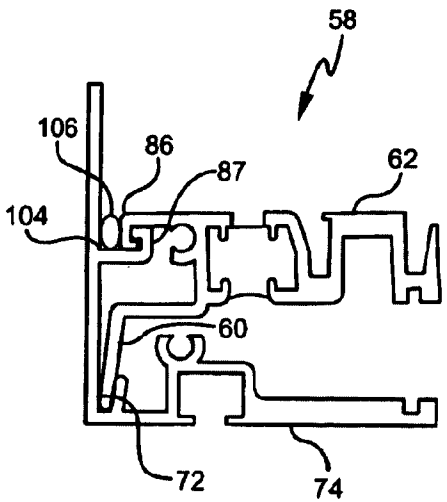
FIG. 8 is a partial cross-sectional view of a coupling formed in accordance with the present invention and shown in FIG. 6, and further illustrating the sequence of steps in joining two components together using the coupling of the present invention.
Figure 10:
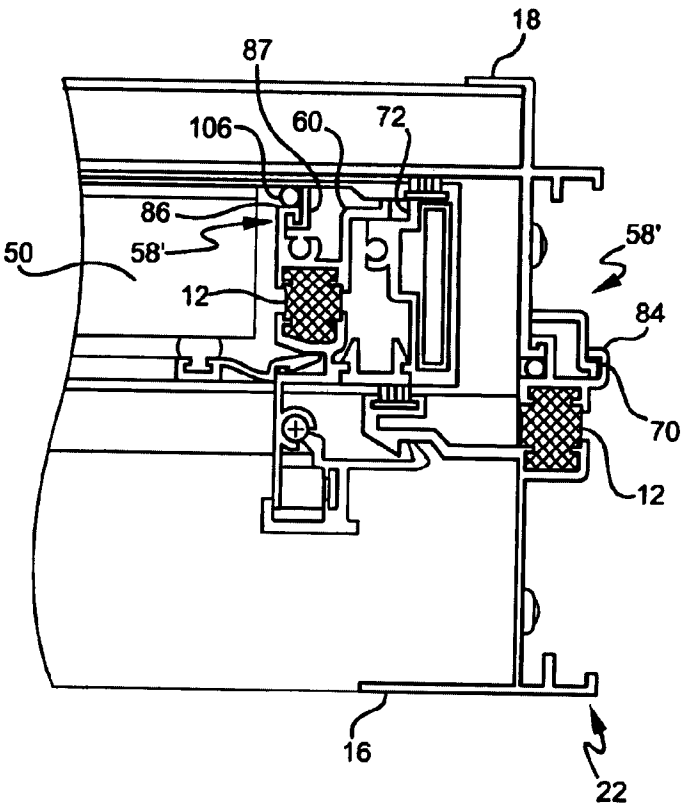
FIG. 10 is a partial cross-sectional view of a head formed in accordance with the present invention and using the coupling of the present invention for use in the construction of a double hung window.
Figure 9:
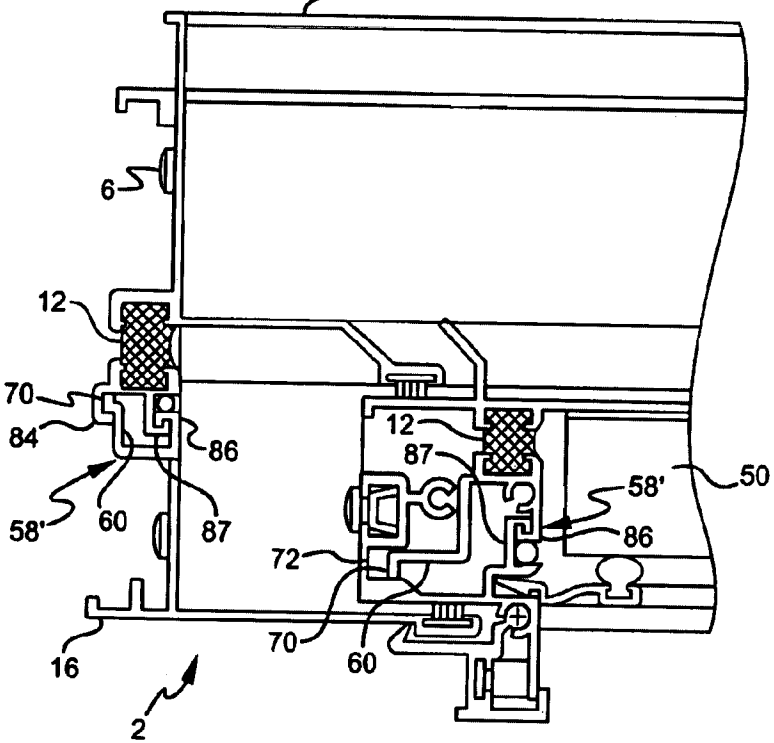
FIG. 9 is a partial cross-sectional view of a sill formed in accordance with the present invention and using the coupling of the present invention for use in the construction of a double hung window.
Figure 11:
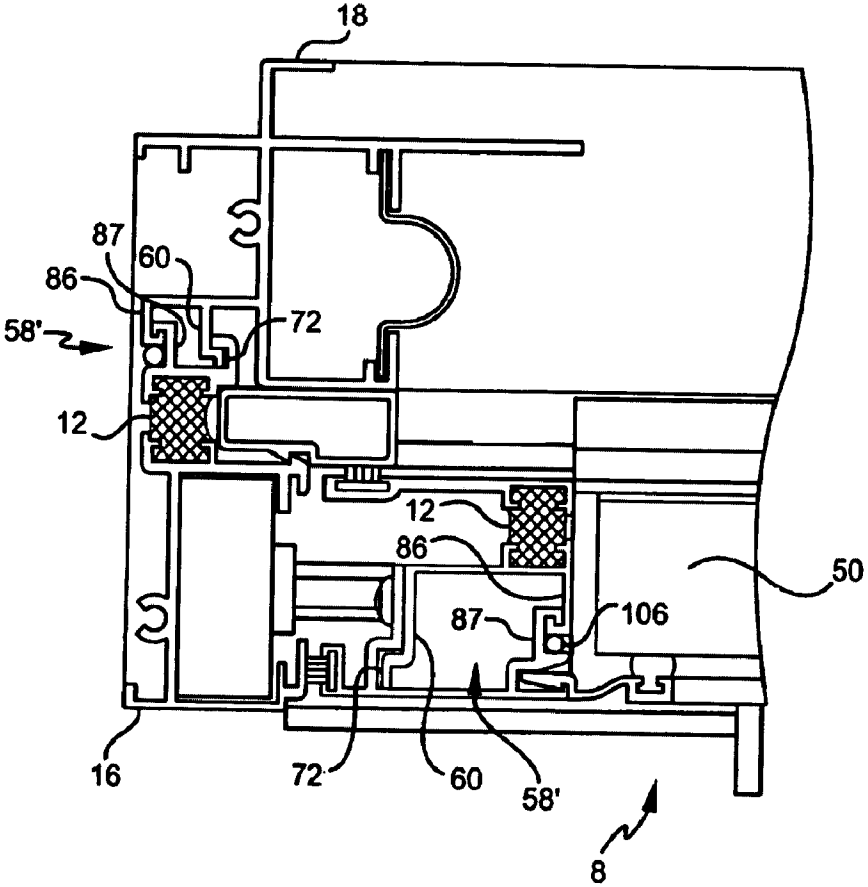
FIG. 11 is a partial cross-sectional view of a left jamb (when viewing the interior side of the window) formed in accordance with the present invention and using the coupling of the present invention for use in the construction of a double hung window.
Figure 12:
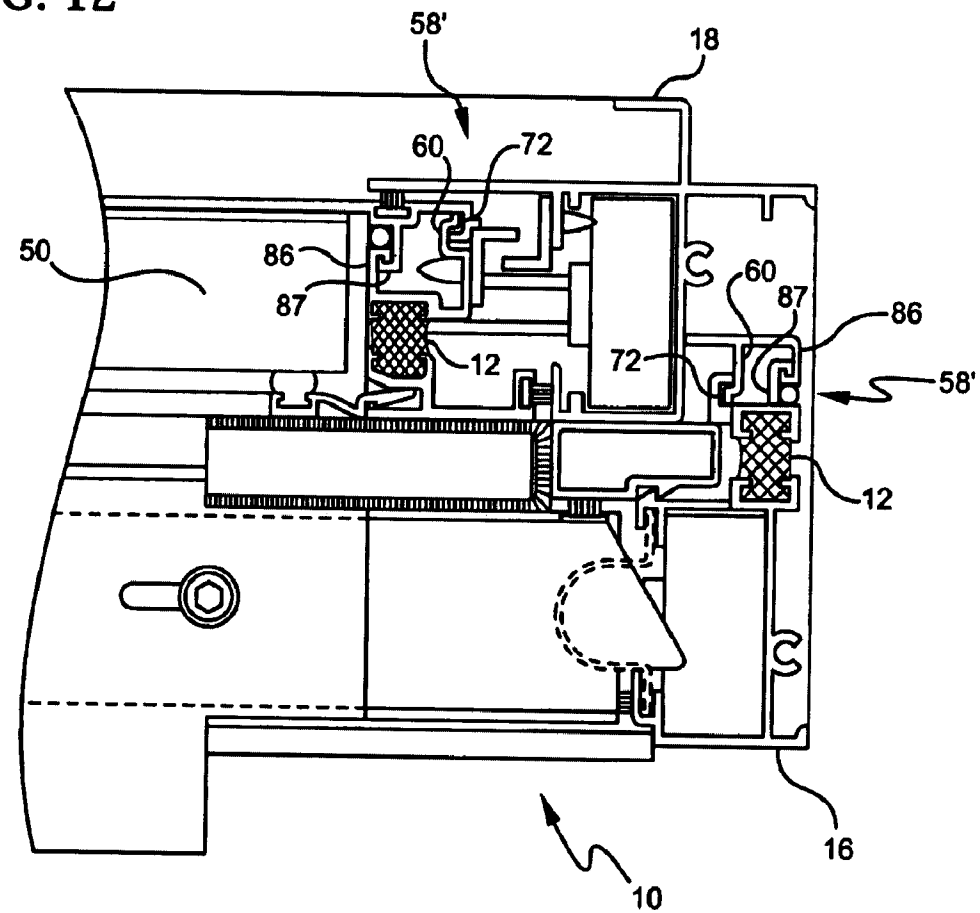
FIG. 12 is a partial cross-sectional view of the right jamb (when viewing the interior side of the window) formed in accordance with the present invention and using the coupling of the present invention for use in the construction of a double hung window.
Figure 13:
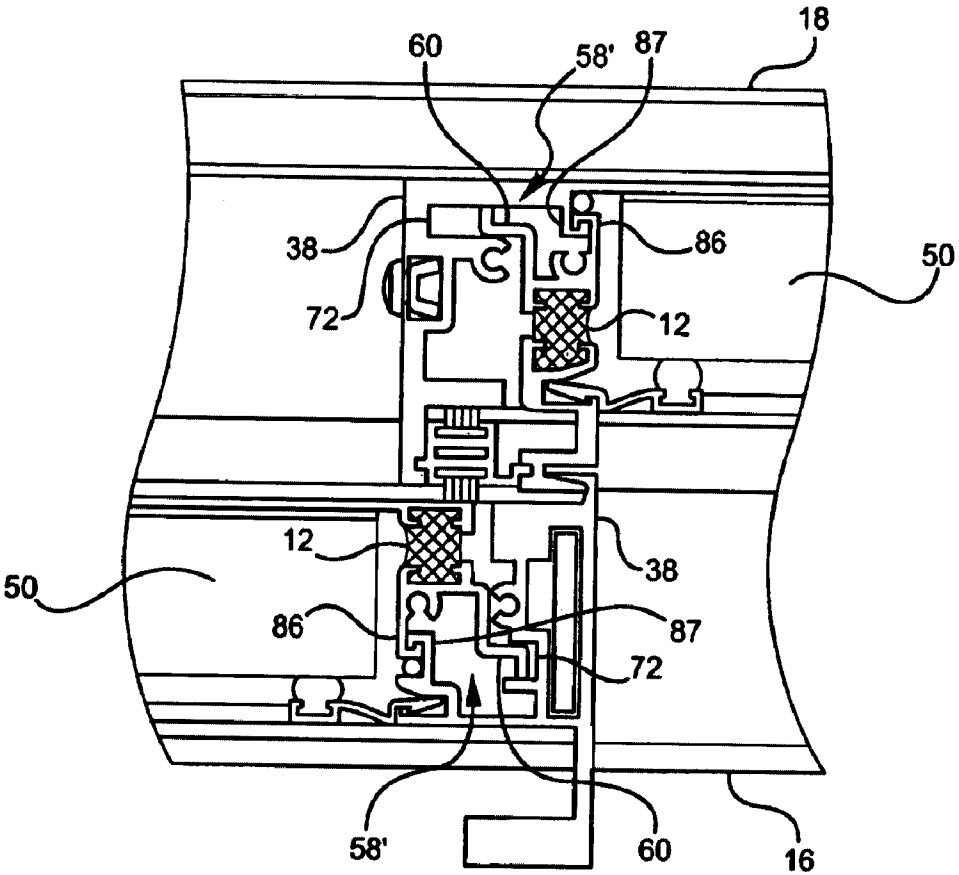
FIG. 13 is a partial cross-sectional view of meeting rails for a double hung window formed in accordance with the present invention and using the coupling of the present invention.

Referring initially to FIGS. 6–8 of the drawings, a coupling 58 for joining two or more parts of a window or door frame, or window sash, formed in accordance with one form of the present invention, is shown. More specifically, the parts, when joined, may form the sill, head or jambs of a window or door frame, or the stiles or rails of a window sash. Even more broadly, the coupling 58 of the present invention shown in FIGS. 6–8 may be used to join together two or more elongated members.

The coupling 58 of the present invention includes an outrigger 60 formed as an elongated member extending from the first component 62 to be joined. The outrigger 60 may include one or more portions. As shown in FIGS. 6–8, it preferably includes a first portion 64, which is joined to and extends from a portion of the first component 62 to be joined, such as the outer shell 4, 24, 26 of the sill, head or jambs of the window or door frame, or the outer shell 40–48 of the stiles or rails of the window sash. Joined at the end of the first portion 64 opposite the end where the first portion is joined to the outer shell of the first component 62 is preferably situated a second portion 66. The second portion 66 preferably extends from the first portion 64 at an angle thereto, which angle is preferably about 90° (such as in the coupling 58' shown in FIGS. 9–13). Even more preferably, the second portion 66 forms an obtuse angle with the first portion 64, which angle is even more preferably about 100°.

Alternatively, and as shown in FIGS. 9–13, the outrigger 60 may further include a third portion 70 which is joined to an end of the second portion 66 and extends at an angle thereto, which angle is preferably about 90°.

The coupling 58 of the present invention further includes an outrigger receiving slot 72. The outrigger receiving slot 72 is formed on the second component 74, which is to be joined to the first component 62, and may be defined by walls or protrusions of the second component. For example, as shown in FIGS. 6–8, the outrigger receiving slot 72 is defined by and between a first wall 76 of the second component 74 and a protrusion 78 or rib extending inwardly of the second component from a second wall 80 of the second component. The protrusion 78 is spaced apart from the first wall 76 to define therebetween the outrigger receiving slot 72. The protrusion 78 may extend perpendicularly from the second wall 80 of the second component 74, or maybe slightly angled thereto, for example, at about 100° measured from the inside of the slot, to define the slot with a widened opening 82, which facilitates the insertion of the outrigger 60, at an angle, into the outrigger receiving slot 72.

Alternatively, and as shown in FIGS. 9–13, the outrigger receiving slot 72 may be defined by a hooked or U-shaped member 84 of the second component 74.

The coupling 58 of the present invention further includes a first hook 86 formed on the first component 62 and spaced a predetermined distance from the outrigger 60 of the first component, and a second hook 87 formed on the second component 74 and spaced a predetermined distance from the outrigger receiving slot 72 of the second component.

Preferably, the first hook 86 includes three portions: a first portion 88 extending outwardly from the outer shell, for example, of the first component 62, and generally in the same direction as the first portion 64 of the outrigger 60; a second portion 90 attached to and extending from an end of the first portion 88, preferably at about a 90° angle thereto; and a third portion 92 attached to and extending from an end of the second portion 90, preferably at about a 90° angle thereto. The third portion 92 is spaced apart from the first portion 88 and extends slightly back toward the outer shell of the first component 62 in a parallel but opposite direction from which the first portion 88 extends so that the third portion 92 defines a free standing, hooked end, and with the first portion 88, defines between them a slot 94 for receiving the hooked end of the second hook 87.

Preferably, the second hook 87 also includes three portions: a first portion 96 which extends outwardly and preferably perpendicularly from a wall (such as the first wall 76) of the outer shell of the first component 62; a second portion 98 attached to and extending from an end of the first portion 96, preferably at about a 90° angle thereto; and a third portion 100 attached to and extending from an end of the second portion 98, preferably at about a 90° angle thereto. The third portion 100 of the second hook 87 is similarly spaced apart from the first portion 96 and extends slightly back toward the first wall 76 of the first component 62 in a parallel but opposite direction from which the first portion 96 extends, so that the third portion 100 defines a free standing hooked end, and with the first portion 96, defines between them a slot 102 for receiving the hooked end of the first hook 86.

FIGS. 6–8 also illustrate how the first and second components 62, 74 are joined together using the coupling 58 of the present invention. In the embodiment of the coupling 58 shown in FIGS. 6–8, the outrigger 60 is shown as being inserted (in the general direction of the arrows) into the outrigger receiving slot 72 at an angle (i.e., the second portion 66 of the outrigger is at an angle to the longitudinal axis of the outrigger receiving slot 72). The angled protrusion 78 of the second component 74 permits the angled entry of the outrigger 60 into the outrigger receiving slot 72.

As shown in FIG. 7, each hooked end (i.e., third portion 92, 100) of the first and second hooks 86, 87 clear each other to allow the outrigger 60 to be received further by the outrigger receiving slot 72. When the outrigger 60 is fully received in its receiving slot 72, the hooked ends of the first and second hooks 86, 87 pass each other and are received in their corresponding slots 94, 102. The hooked ends 92, 100 of each of the first and second hooks prevent movement of the first and second components 62, 74 with respect to one another and further maintain the outrigger 60 in position in its outrigger receiving slot 72. The first and second hooks 86, 87 are now fully engaged, as shown in FIG. 8, to secure the first and second components together.

As shown in FIG. 8, when the first and second components 62, 74 are assembled, the first hook 86 of the first component 62 and a wall 76 of the second component 74 define a space 104 between them. A locking spline 106, which is preferably resilient, or another member, such as a wedge or the like, is press-fitted into the space 104 between the first hook 86 and the wall 76 to selectively prevent disengagement of the first and second hooks 86, 87 and to maintain the components as an assembled structure. The locking spline 106, wedge or the like, need not be a continuous member that extends along the longitudinal length of the first and second components. Rather, it may be a plurality of periodically spaced apart, discrete members which are force-fitted into the space 104 between the first hook 86 and the wall 76 of the second component 74 to exert pressure on the first hook 86 so that it remains engaged with the second hook 87 to prevent the first and second components 62, 74 from inadvertently separating.

It should be noted that the locking spline 106, wedge or the like is preferably removable so that, if desired, the first and second components 62, 74 may be separated in the event, perhaps, that one or the other of the first and second components may be replaced with another component having a different depth, a different finish or formed of a different material from that of the substituted component.

FIGS. 9–13 illustrate a two part, double hung window formed in accordance with the present invention and using a coupling 58' of the present invention. It should be understood that, although a double hung window is illustrated by FIGS. 9–13, the two part window and door assembly, and coupling for interconnecting components thereof, are applicable to all types of windows and doors, including fixed, double hung, sliding, tilt and turn, tilt before turn and casement windows, and sliding and French doors.

The coupling 58' of the present invention is shown as being formed in the outer shell 4, 24, 26 of the sill 2, head 22 and jambs 8, 10 (FIGS. 9–12), and in either the outer shell 40–48 or in a component which mates with the outer shell in the stiles 34, 36 and rails 30, 32, 38 of the window sash shown in FIGS. 9–13. All of the other structure and parts of the frame and window sash shown in FIGS. 9–13 are the same as those shown in the conventional double hung window illustrated by FIGS. 1–5, and like reference numbers in each figure refer to like parts.

In the coupling 58' shown in FIGS. 9–13, the outrigger 60 may be inserted into the outrigger receiving slot 72 at an angle, or the outrigger receiving slot 72 may be approached by the outrigger 60 in a direction parallel with the longitudinal axis of the receiving slot. The first and second hooks 86, 87 engage each other to secure the components of the frame and window sash together, and the locking spline 106 is inserted between the first hook 86 and a wall 76 of the second component to maintain the engagement of the first and second hooks 86, 87, and to prevent the outrigger 60 from disengaging from its corresponding outrigger receiving slot 72. In the coupling 58' shown in FIGS. 9–13, the transverse third portion 70 of the outrigger is closely received by the outrigger receiving slot 72 and ensures a tight fit between the assembled first and second components.

It may be also seen from the sill, head, rails and stiles shown in FIGS. 9–13 that, preferably, the outrigger 60 is situated to face the outer periphery of the window or door, with the first and second hooks 86, 87 and locking spline 106 being situated inwardly of the outrigger 60 in relation to the outer periphery of the window or door. This is because the outrigger 60 will conceal from view the locking spline 106 when the window or door is installed and in the closed position.

It should be further noted here that the locking spline 106 acts as the primary means for preventing the disengagement of the first and second hooks 86, 87 and, consequently, the separation of the joined first and second components 62, 74. However, after the window or door frame and window sash are fully assembled, the assembled sash exerts pressure on the sill 2 and head 22, and the glazing (with its arrangements of brackets 52 and beads 54) exert pressure on the stiles 34, 36 and rails 30, 32, 38, to force the first and second hooks 86, 87 together and thus acts as a secondary means for preventing their disengagement.

By providing inner and outer frame and sash members that are coupled together, the option of different interior and exterior surfaces is afforded. For example, the exterior side 18 of the frame and window sash may be made from one material and/or color, while the interior side 16 may be made from another. As a result of the present invention, a window frame assembly or door may be custom assembled to match the exterior and interior decor of the building structure in which the window or door assembly is to be mounted. Components may be shipped unassembled and then assembled at the building site to satisfy the need for variations of framing member design. For example, the overall thickness of the window or door assembly may be varied by interchanging differently sized inner and outer frame members and sash members.

Figure 14:
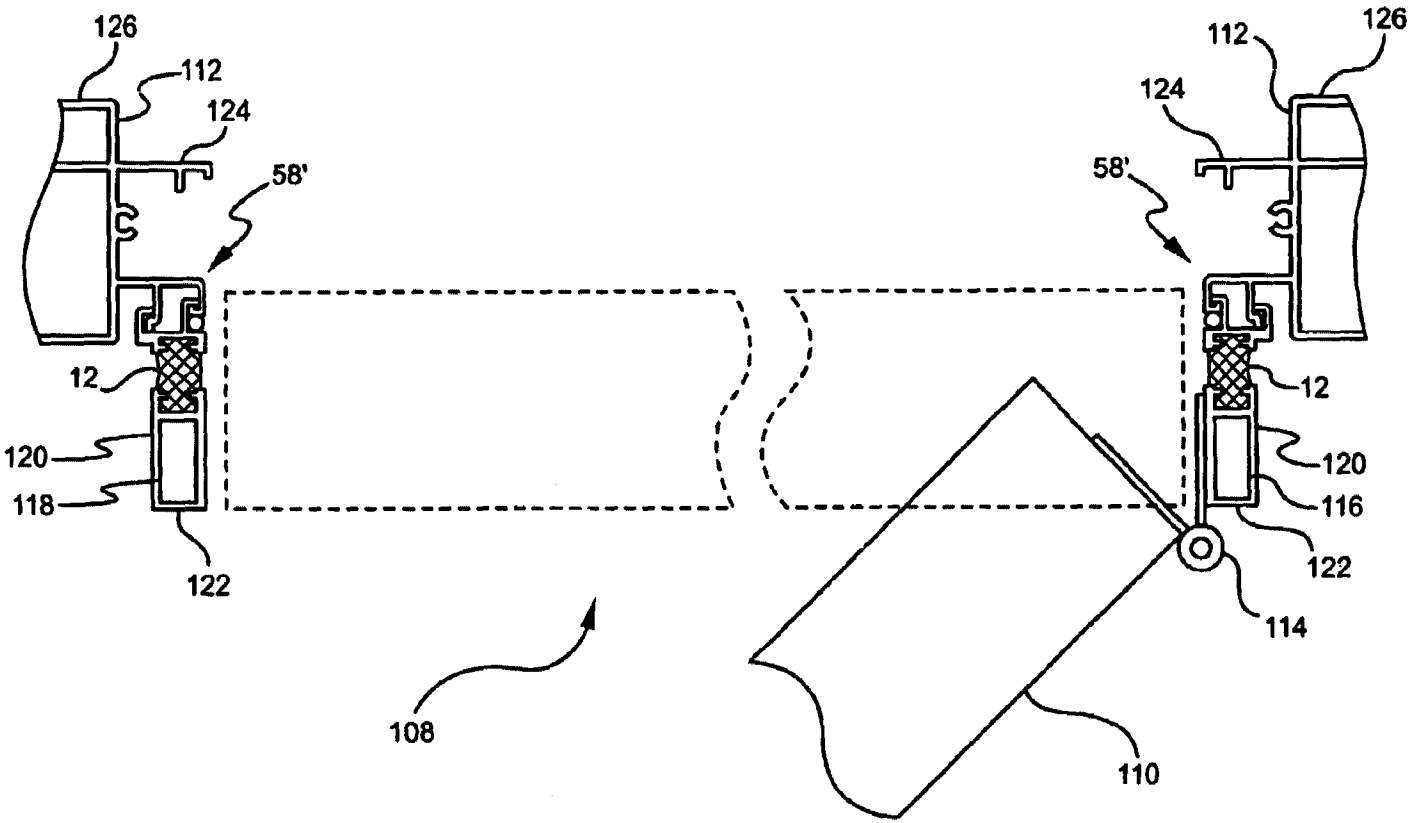
FIG. 14 is a cross-sectional view of a door assembly formed in accordance with the present invention.

As mentioned throughout, the coupling 58, 58' of the present invention may be incorporated into other structural assemblies, such as a door frame. FIG. 14 illustrates the present invention in the form of a door frame assembly 108 for a swinging door. The door frame assembly 108 generally includes a door 110 mounted in a door frame 112 by hinges 114. However, the present invention may accommodate any type of door including hinged doors and sliding doors and any number and combination thereof.

The door frame includes left and right jambs, one being a hinge jamb 116 and the other being a lock jamb 118, a head (not shown) and, optionally, a sill (not shown), the head and sill connecting the hinge and lock jambs 116, 118. The door jambs 116, 118 include an inner frame member 120 forming an interior side 122 of the door frame and an outer frame member 124 forming an exterior side 126. The inner and outer door frame members 120, 124 are structural extrusions which are coupled together using the coupling 58, 58' of the present invention described previously. Accordingly, FIG. 14 shows the inner and outer frame members 120, 124 having the preferred coupling 58' and a thermal break 12 as described previously. The head and optional sill would also include a similar coupling 58' and have similar structure to the hinge and lock jambs 116, 118 shown in FIG. 14 or the left and right jambs 8, 10 described previously with respect to the window shown in FIGS. 9–13. Thus, the interior side 122 of the door frame may be made from a different material and/or color than the exterior side 126 of the door frame.

It should be realized, however, that the two part window and door assembly, and coupling, of the present invention may be incorporated in all types of window and door assemblies, such as skylights and greenhouse panels, whether or not such windows or doors include a thermal break. Even more broadly, the coupling of the present invention may be used wherever it is desired to join two or more elongated construction members together.

The first and second components of each part of the window or door assembly are preferably extruded, although they may be formed in other ways. They are preferably made of metal, such as aluminum; however, other durable materials including wood, fiberglass and high-strength plastics, such as vinyl, may be used. Typically, the lengths of the extruded components are twenty feet or more. After they are extruded, they are painted (i.e., finished). The advantage of the two part window and door assembly of the present invention is that the components may be joined together in their raw lengths using the coupling of the present invention, where one part may have a different finish or depth, or may be formed from a different material, from the other part to which it is joined. Subsequently, the joined parts are then transversely cut to selected lengths to form the joined jamb, sill, head, stile or rail. These components are then assembled to form the frame of the window or door, or the window sash.

The two part window and door assembly, and the coupling, of the present invention, provide greater versatility in the selection and use of the parts comprising the finished assembly, while the coupling of the present invention maintains the integrity of the various joined components of the window and door assembly. In the event that a change must be made in the joined components of the window and door assembly, or even after the joined components have been assembled to form the window and door frame or window sash, the locking spline, wedge or the like may be removed to allow disassembly of the structure and substitution of different components used therein.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A window assembly, which comprises:

a frame and a sash mounted on the frame, at least one of the frame and the sash having a first window component and a second window component; and a coupling joining the first window component and the second window component together, the coupling including:

an outrigger formed as an elongated member disposed on the first window component;

the second window component defining an outrigger receiving slot;

a first hook disposed on the first window component and spaced a predetermined distance from the outrigger;

a second hook disposed on the second window component and spaced a predetermined distance from the outrigger receiving slot, the outrigger being received by the outrigger receiving slot and the first and second hooks engaging one another to secure the first and second window components together, the first hook defining with the second window component a space therebetween; and a locking component, the locking component being received in the space between the first hook and the second window component to prevent the disengagement of the first and second hooks.

2. A window assembly as defined by claim 1, wherein the first window component includes a component portion; and wherein the outrigger includes at least a first portion and a second portion, the first portion joined to and extending from the component portion of the first window component, the first portion having an end, the second portion being joined to the end of the first portion and extending therefrom at an angle thereto.

3. A window assembly as defined by claim 2, wherein the second portion of the outrigger extends from the first portion of the outrigger at an angle of about 90°.

4. A window assembly as defined by claim 2, wherein the first portion of the outrigger extends from the second portion of the outrigger at an angle of about 100°.

5. A window assembly as defined by claim 2, wherein the second portion includes an end; and wherein the outrigger includes a third portion, the third portion extending from the end of the second portion of the outrigger at an angle thereto.

6. A window assembly as defined by claim 5, wherein the third portion of the outrigger extends from the second portion of the outrigger at angle of about 90°.

7. A window assembly as defined by claim 2, wherein the second window component includes a first part and a second part; and wherein the outrigger receiving slot is defined by and between the first part and the second part of the second window component.

8. A window assembly as defined by claim 7, wherein the second part is disposed at an angle with respect to the first part to define the outrigger receiving slot with a widened mouth to facilitate receiving the outrigger therein.

9. A window assembly as defined by claim 1, wherein each of the first window component and the second window component includes a component portion: and wherein each of the first hook and the second hook includes a first portion, a second portion and a third portion, each of the first portions extending outwardly from the respective component portion of the first window component and the second window component, each of the first portions of the first and second hooks having an end, each of the second portions of the first and second hooks extending from the end of the respective first portion of the first hook and the second hook and transversely thereto, each of the second portions of the first and second hooks having an end, each of the third portions of the first and second hooks extending from the end of the respective second portion of the first and second hooks and transversely thereto, each of the third portions of the first and second hooks being spaced apart from the respective first portion of the first and second hooks to define with the respective first portion a slot, the slot of the first hook receiving the third portion of the second hook, and the slot of the second hook receiving the third portion of the first hook.

10. A window assembly as defined by claim 1, wherein the locking component is selectively removable from the space between the first hook and the second window component to allow the disjoining of the first window component and the second window component.

11. A door assembly, which comprises:

a frame, the frame having a first door component and a second door component; and a coupling joining the first door component and the second door component together, the coupling including:

an outrigger formed as an elongated member disposed on the first door component;

the second door component defining an outrigger receiving slot;

a first hook disposed on the first door component and spaced a predetermined distance from the outrigger;

a second hook disposed on the second door component and spaced a predetermined distance from the outrigger receiving slot, the outrigger being received by the outrigger receiving slot and the first and second hooks engaging one another to secure the first and second door components together, the first hook defining with the second door component a space therebetween; and a locking component, the locking component being received in the space between the first hook and the second door component to prevent the disengagement of the first and second hooks.

12. A coupling for joining together a first component and a second component, the coupling including:

an outrigger formed as an elongated member disposed on the first component;

the second component defining an outrigger receiving slot;

a first hook disposed on the first component and spaced a predetermined distance from the outrigger;

a second hook disposed on the second component and spaced a predetermined distance from the outrigger receiving slot, the outrigger being received by the outrigger receiving slot and the first and second hooks engaging one another to secure the first and second components together, the first hook defining with the second component a space therebetween; and a locking component, the locking component being received in the space between the first hook and the second component to prevent the disengagement of the first and second hooks.

13. A coupling as defined by claim 12, wherein the first and second components are parts of one of a window and a door.

14. A window assembly, which comprises:

a frame and a sash mounted on the frame, at least one of the frame and the sash having a first window component and a second window component; and a coupling joining the first window component and the second window component together, the coupling including:

an outrigger formed as an elongated member disposed on the first window component;

the second window component defining an outrigger receiving slot;

a non-crimpable first hook disposed on the first window component and spaced a predetermined distance from the outrigger;

a non-crimpable second hook disposed on the second window component and spaced a predetermined distance from the outrigger receiving slot, the outrigger being received by the outrigger receiving slot and the non-crimpable first and second hooks non-crimpably engaging one another to selectively secure and unsecure the first and second window components together, the non-crimpable first hook defining with the second window component a space therebetween; and a removable locking component, the removable locking component being removably received in the space between the non-crimpable first hook and the second window component to selectively prevent and allow the disengagement of the non-crimpable first and second hooks.

15. A door assembly, which comprises:

a frame, the frame having a first door component and a second door component; and a coupling joining the first door component and the second door component together, the coupling including:

an outrigger formed as an elongated member disposed on the first door component;

the second door component defining an outrigger receiving slot;

a non-crimpable first hook disposed on the first door component and spaced a predetermined distance from the outrigger;

a non-crimpable second hook disposed on the second door component and spaced a predetermined distance from the outrigger receiving slot, the outrigger being received by the outrigger receiving slot and the non-crimpable first and second hooks non-crimpably engaging one another to selectively secure and unsecure the first and second door components together, the non-crimpable first hook defining with the second door component a space therebetween; and a removable locking component, the removable locking component being removably received in the space between the non-crimpable first hook and the second door component to selectively prevent and allow the disengagement of the non-crimpable first and second hooks.

16. A coupling for joining together a first component and a second component, the coupling including:

an outrigger formed as an elongated member disposed on the first component;

the second component defining an outrigger receiving slot;

a non-crimpable first hook disposed on the first component and spaced a predetermined distance from the outrigger;

a non-crimpable second hook disposed on the second component and spaced a predetermined distance from the outrigger receiving slot, the outrigger being received by the outrigger receiving slot and the non-crimpable first and second hooks non-crimpably engaging one another to selectively secure and unsecure the first and second components together, the non-crimpable first hook defining with the second component a space therebetween; and a removable locking component, the removable locking component being removably received in the space between the non-crimpable first hook and the second component to selectively prevent and allow the disengagement of the non-crimpable first and second hooks.

* * * * *